United States Patent [19]

Scherbarth et al.

[11] Patent Number: 4,841,833

[45] Date of Patent: Jun. 27, 1989

[54] ROTARY SWITCH FOR MULTIPLE SHOT ELECTROMAGNETIC LAUNCHERS

[75] Inventors: David W. Scherbarth, Plum Borough; Daniel W. Deis, Churchill Borough; John W. Olsen, Plum Borough, all of Pa.

[73] Assignee: Westinghouse Electric Corp., Pittsburgh, Pa.

[21] Appl. No.: 404,671

[22] Filed: Aug. 3, 1982

[51] Int. Cl.[4] ..... F41F 1/02; H01H 25/06

[52] U.S. Cl. ..... 89/8; 124/3; 200/11 A; 200/572; 310/12

[58] Field of Search ..... 89/8; 124/3; 310/10, 310/13, 12; 200/1 V, 8 R, 8 A, 11 R, 11 A, 144 R, 144 A, 144 AP, 147 R, 148 C, 148 G, 151, 156, 158, 146.7

[56] References Cited

U.S. PATENT DOCUMENTS

| | | | |
|---|---|---|---|
| 2,277,422 | 3/1942 | Walle | 200/151 |
| 2,528,520 | 11/1950 | Jackson et al. | 200/156 |
| 3,120,585 | 2/1964 | Harris et al. | 200/156 |
| 3,284,585 | 11/1966 | Hall | 200/11 R |
| 4,052,576 | 10/1977 | Smith | 200/147 R |
| 4,369,691 | 1/1983 | Baehr et al. | 89/8 |
| 4,369,692 | 1/1983 | Kemeny | 89/8 |
| 4,426,562 | 1/1984 | Kemeny | 200/8 A X |
| 4,429,613 | 2/1984 | Deis et al. | 89/8 |
| 4,433,607 | 2/1984 | Kemeny | 89/8 |

OTHER PUBLICATIONS

DTIC Technical Report Entitled "Study of an Electromagnetic Gun System for Air Defense", by I. R. McNab & O. W. Deis, AFATL-TR-81-99, pp. 77-94.

*Primary Examiner*—David H. Brown
*Assistant Examiner*—John E. Griffiths
*Attorney, Agent, or Firm*—R. P. Lenart

[57] ABSTRACT

An electromagnetic projectile launcher is provided with a firing switch which alternately opens and closes to repeatedly commutate current from a high current supply to a pair of projectile launching rails. A rotor having a transverse conducting element is rotated within and moved axially along a cylindrical stator. Brush members which have widths which decrease in an axial direction along the stator are shorted by the conducting element between shots for varying lengths of time as the rotor travels axially along the stator.

18 Claims, 3 Drawing Sheets

ROTARY SWITCH FOR MULTIPLE SHOT ELECTROMAGNETIC LAUNCHERS

STATEMENT OF GOVERNMENT INTEREST

The United States Government has rights in this invention pursuant to Contract No. FO8635-81-C-0107 awarded by the Department of Defense.

BACKGROUND AND SUMMARY OF THE INVENTION

This invention relates to electromagnetic projectile launchers and more particularly to switches for use in switching the very large DC currents employed in the electromagnetic propulsion of projectiles.

Electromagnetic projectile launchers are known which comprise a source of high current, a pair of conductive projectile launching rails, a sliding conductive armature for conducting current between the rails and for propelling a projectile along the rails, and a switch for commutating current from the high current source into the rails and the armature. The electromagnetic forces generated by the injection into the launcher rails of a very large DC current drive the projectile down the rails and out of the muzzle at very high velocities. Various switch designs have been utilized or proposed to perform the rapid switching of high current required in the electromagnetic launching of projectiles.

A rail switch has been used which is actually a second parallel rail device with one of its rails connected to the breech end of each of the launcher rails with a non-conducting section in between. An armature, which is in sliding electrical contact with the rails, is driven down the switch rails by the electromagnetic forces generated by a very large DC current to be switched. When the armature passes the non-conducting section of one switch rail, a massive arc is struck between the armature and a section of one rail which it is leaving. As the armature continues down the switch rails, the arc lengthens, thereby increasing arc voltage which results in the injection of current into the launcher rails. While the rail switch provides rapid commutation of the current into the launcher rails, due to the high speed of the switch armature at the time the arc is struck, it is bulky, expensive and requires means for stopping the armature after commutation, for returning it to the starting point, and for restraining it against the forces generated by the applied current preparatory to a second firing. Thus the rail switch is not adequately suitable for a burst or rapid firing of the launcher.

A rotary switch has been proposed in which a conducting element within a cylindrical rotor is rotated to alternately make and break contact with at least two brush members which are located adjacent the rotor surface. When the rotor is turned to a first position, a very large DC current applied to one of the brush members flows from that brush member through the conducting element on the rotor and out through the other brush member. When the rotor is rotated to a second position, the conducting element is no longer in electrical contact with the brush member to which the very large current is applied, thereby interrupting the flow of this current from the one brush member to the other through the conducting element. This interruption of current flow can be used to inject current into the rails of an electromagnetic launcher. The present invention involves an improvement in the rotary switch concept for use in an electromagnetic projectile launcher which is required to launch a burst of projectiles in rapid succession.

The high current source of an electromagnetic projectile launcher may, for example, include the series connection of a direct current generator such as a homopolar generator, a switch and an inductive energy store. Prior to a launch, the switch would be closed, and the high current source would be shorted by a firing switch, allowing the generator to charge the inductor to a previously determined high current level. Once this current level has been achieved, the firing switch will be opened, thereby commutating current into a pair of projectile launching rails and through a sliding conductive armature between the rails. In order to launch a burst of projectiles in rapid succession and at approximately the same muzzle velocity, the firing switch must alternately close and open, remaining closed between each shot for a time period long enough for the current in the inductive energy store to be increased to the predetermined firing level. If a homopolar generator is used to provide current for the inductive energy store, the generator voltage after each shot will be reduced, thereby requiring a longer charging time to achieve the firing current level in the inductor. Therefore, in order to launch a burst of projectiles at approximately the same muzzle velocity, the firing time of the projectiles will be constant, while the charging time between shots is variable. A rotary switch which performs the firing switch function must therefore be capable of acting as a short across the breech end of a pair of projectile launching rails for a variable time while being in the open circuit position for a fixed time for each shot of a burst. A switch constructed in accordance with the present invention utilizes variable width brush members to meet this requirement.

The present invention switch comprises: a cylindrical rotor; a conducting element extending traversely through and axially along the rotor; a stator having an inner cylindrical surface; two brush members at angularly spaced locations on the stator cylindrical surface, each brush member terminating in an arcuate surface complementary to and in sliding electrical contact with the cylindrical surface of the rotor, with the width of said arcuate surfaces increasing in an axial direction along the stator cylindrical surface; means for rotating the rotor; and means for moving the rotor axially along the stator. An electromagnetic projectile launcher constructed in accordance with the present invention utilizes the above switch and further includes: a source of high current connected between the brush members; a pair of conductive projectile launching rails, each of the rails connected to one of the brush members; and means for conducting current between the rails and for propelling a projectile along the rails. During the launch of a burst of projectiles, the rotor rotates within the cylinder of the stator and travels axially along the stator. Since the brush member width varies axially along the stator, the width of the spaces between the brush members varies inversely in the same direction. Therefore, in order to achieve a variable charging time and a constant firing time during the burst sequence, the rotor must change speed monotonically as it travels along the stator.

DESCRIPTION OF THE PREFERRED EMBODIMENT

Figure 1:
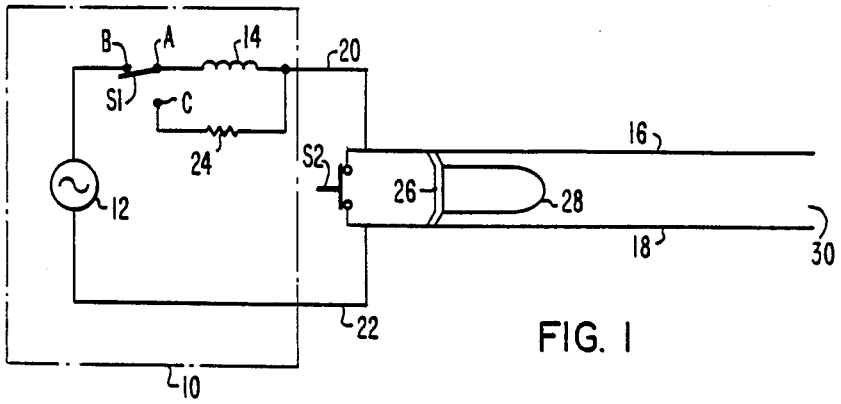
FIG. 1 is a schematic diagram of an electromagnetic projectile launcher in accordance with one embodiment of the present invention.

Referring to the drawings, FIG. 1 is a schematic representation of an electromagnetic projectile launcher constructed in accordance with the present invention. A high current source 10 comprising the series connection of generator 12, switch S1 and inductive energy store 14 is connected to a pair of conductive projectile launching rails 16 and 18 by way of bus bars 20 and 22. Resistor 24 is capable of being connected across inductive energy store 14 to dissipate remaining stored energy following the launching of a burst of projectiles. Switch S2 is connected across the breech ends of conductive rails 16 and 18 and serves as the firing switch for the launcher. A conductive armature 26 is slidably disposed between conductive rails 16 and 18 and serves as a means for conducting current between these rails and for propelling projectile 28 along the rails.

To begin a launch sequence, switch S1 is actuated to short terminals A and B and switch S2 is initially closed. This allows generator 12, which may be a homopolar generator, to charge inductive energy store 14 to a predetermined firing current level. Once this firing current level has been reached, switch S2 is opened, thereby rapidly commutating current into rails 16 and 18 and through armature 26. This current flow places an electromagnetic force on armature 26 which propels it and projectile 28 along rails 16 and 18. If a burst of projectiles is to be fired, switch S2 must reclose following the firing of the first projectile to allow the current through inductive energy store 14 to build up to the predetermined firing current level. During this recharging, a new projectile and armature are inserted in the breech of bore 30 and S2 will be opened when the firing current level is again achieved. Following the burst, switch S1 is switched to short terminals A and C, thereby dissipating any remaining energy stored in inductive energy store 14 through discharge resistor 24. It should be understood that if generator 12 is a homopolar generator, its generator brushes can serve as an additional switch which may be used to initially make contact but are unsuitable for rapid breaking of contact under load.

Figure 2:
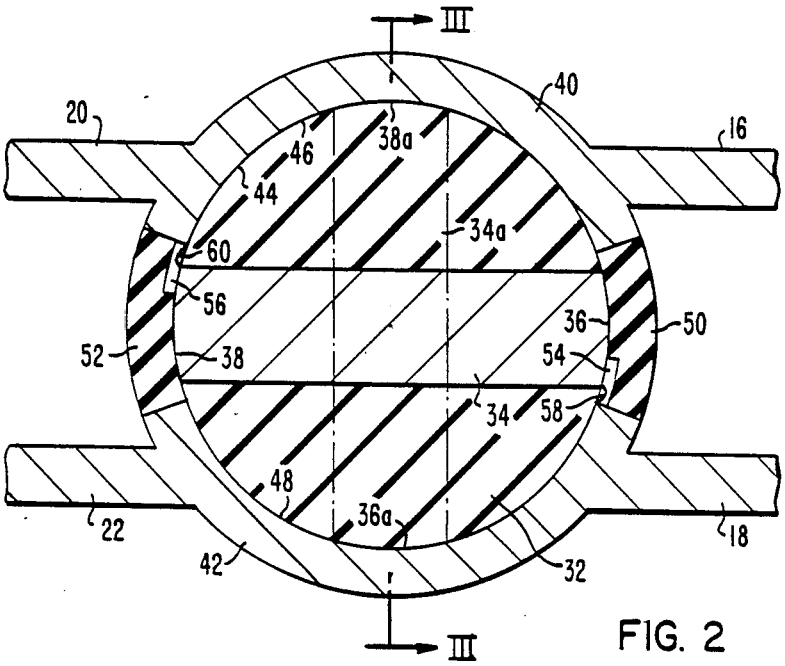
FIG. 2 is a cross-section of the firing switch of the launcher of FIG. 1, taken along line II—II of FIG. 3.

During the firing of a burst of projectiles, it is anticipated that the voltage of generator 12 will decrease as successive projectiles are fired, thereby requiring a longer time for the firing current level to be reestablished in inductive energy store 14. To achieve an approximately constant velocity for each projectile, the actual launch time of each projectile will be approximately constant. Therefore, switch S2 must remain open for a constant period of time for each projectile but must remain closed for a variable time which will increase with successive shots due to the decrease in generator voltage. FIG. 2 is a cross-section of switch S2 of the launcher of FIG. 1 which is constructed to perform the various functions required. A cylindrical rotor 32 is disposed within a stator and includes a conducting element 34 extending traversely through and axially along the rotor. The conducting element 34 includes radial ends 36 and 38 which terminate at angularly spaced locations on the cylindrical surface of rotor 32. The stator includes two brush members 40 and 42 at angularly spaced locations on a stator cylindrical surface 44. Each of the brush members terminates in an arcuate surface 46 and 48, which is complementary to and in sliding electrical contact with the cylindrical surface of rotor 32. The width of these arcuate surfaces increases in an axial direction along stator cylindrical surface 44. Insulation members 50 and 52 are disposed between brush members 40 and 42 along inner cylindrical surface 44. These insulation members define arc chambers 54 and 56 which are located along a portion of inner cylindrical surface 44. Means for rotating rotor 32, not shown in this view, is provided to rotate conducting element 34 from the position designated by reference numerals ending in "a" wherein brush members 40 and 42 are shorted by conducting element 34 to a second position wherein conducting element 34 is insulated from brush members 40 and 42. As current is broken by this rotating action, arcs 58 and 60 form in arc chambers 54 and 56 until current is commutated into rails 16 and 18.

Figure 3:
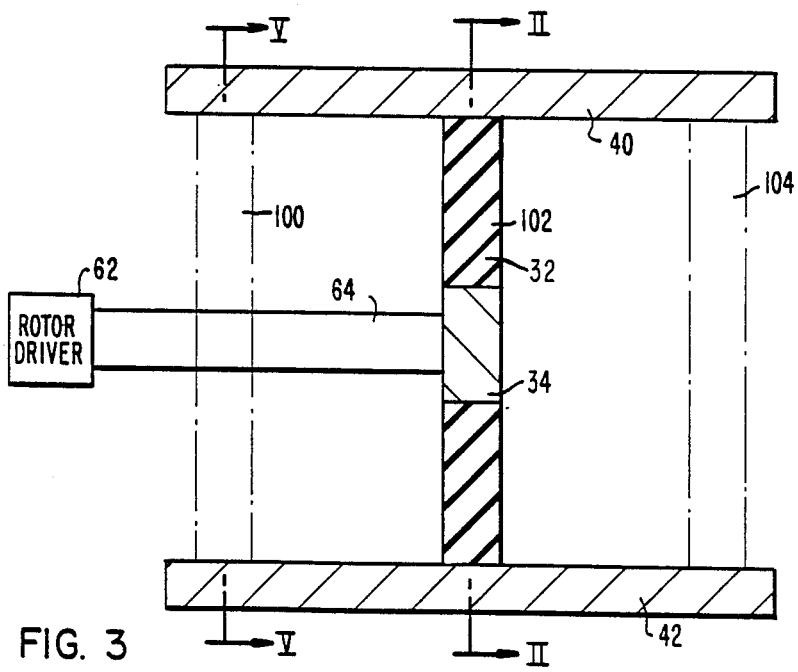
FIG. 3 is a cross-section of the firing switch of FIG. 2, taken along line III—III of FIG. 2.

FIG. 3 is a cross-section of switch S2 of the launcher of FIG. 1 taken along line III—III of FIG. 2. Rotor driving means 62 is connected by way of shaft 64 and serves to rotate the rotor and move the rotor axially along the stator during a firing burst sequence. In this embodiment, the rotor 32 would initially be at position 100 and move through position 102 to position 104 during a burst sequence. As the rotor travels axially along the stator, its speed would monotonically decrease to insure that the firing time for successive projectiles is constant while the charging time between successive projectiles increases throughout the burst.

Figure 4:
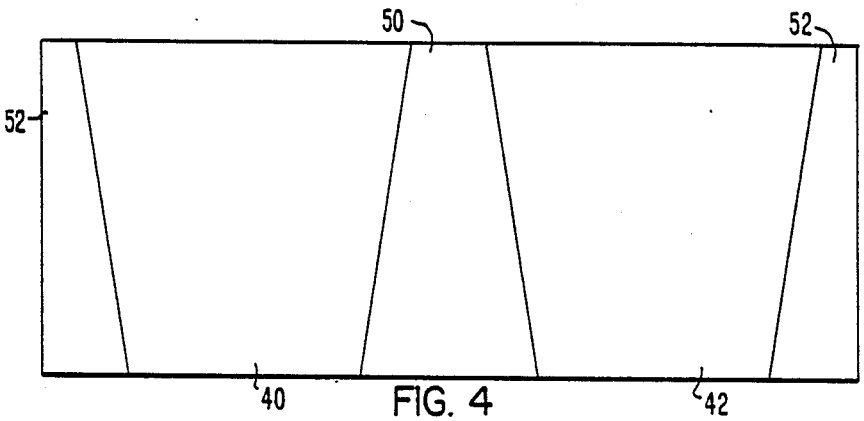
FIG. 4 is a development view of the inner cylindrical surface of the stator of the firing switch of FIG. 2.

FIG. 4 is a development view of inner cylindrical surface 44 of the stator of the switch of FIG. 2. It can be seen that the arcuate surfaces of brush members 40 and 42 as well as insulation members 50 and 52, vary in width in an axial direction along the stator.

Figure 5:
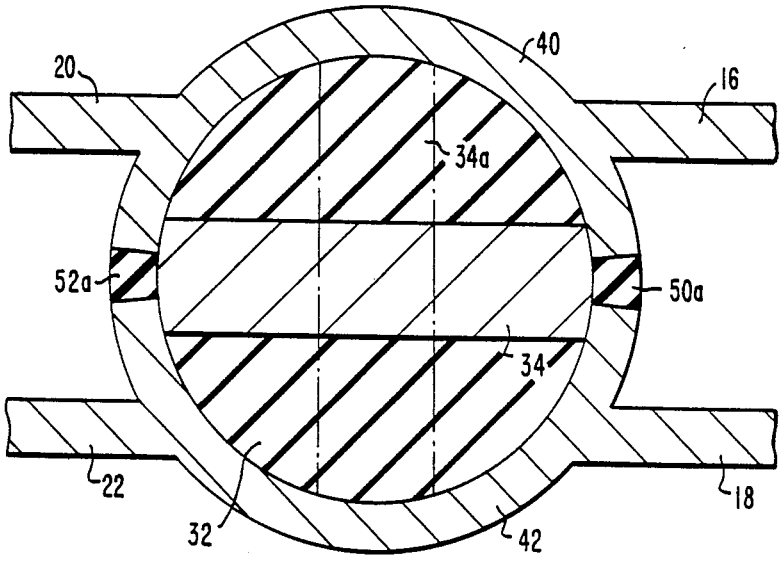
FIG. 5 is a cross-section of the firing switch of FIG. 2 taken along line V—V of FIG. 3.

FIG. 5 is a cross-section of an alternative firing switch in accordance with the present invention for use in the launcher of FIG. 1. In this embodiment, conducting element 34 is shown in a position corresponding to rotor position 102 in FIG. 3. Insulation members **50*a* and 52*a* correspond to insulation members 50 and 52 in the switch of FIG. 2, but have been reduced in size so that each has a width less than the width of the radial ends of conducting element 34. This construction allows conducting element 34 to continually short brush members 40 and 42 so that rotor 32 can be revved up to an initial predetermined speed prior to its axial movement along the stator. The design of rotor driver 62** is therefore simplified by eliminating any requirement for high accelerating forces on the rotor.

Figure 6:
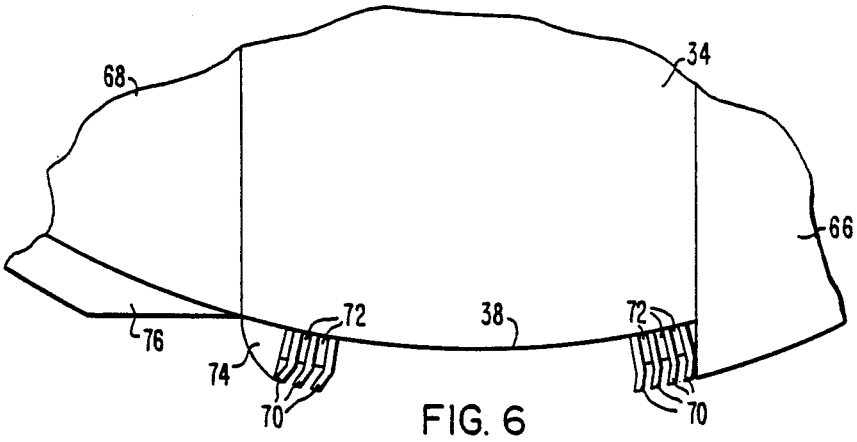
FIG. 6 is an enlarged view of a portion of the rotor of the firing switch of FIG. 2.

FIG. 6 is an enlarged view of a portion of rotor 32 illustrating a sliding contact arrangement in accordance with one embodiment of this invention. Conducting element 34 is disposed between insulating elements 66 and 68 within rotor 32. A plurality of conducting leaves 70 are connected to the radial end 38 of conducting element 34 to provide sliding electrical contact with the brush members not shown in this view. These leaves 70 may be made of a conducting material such as copper-zirconium and are spaced by spacers 72 which may be made of a conducting material such as aluminum. Arc horn 74, which may be a copper protrusion, serves as an arcing contact when conducting element 34 moves away from a brush element. The use of an arc horn prevents the vaporization of the trailing conductive leaves 70 as an arc is drawn. An arc resistant structure 76 is added to prevent arc damage to rotor 32.

Figure 7:
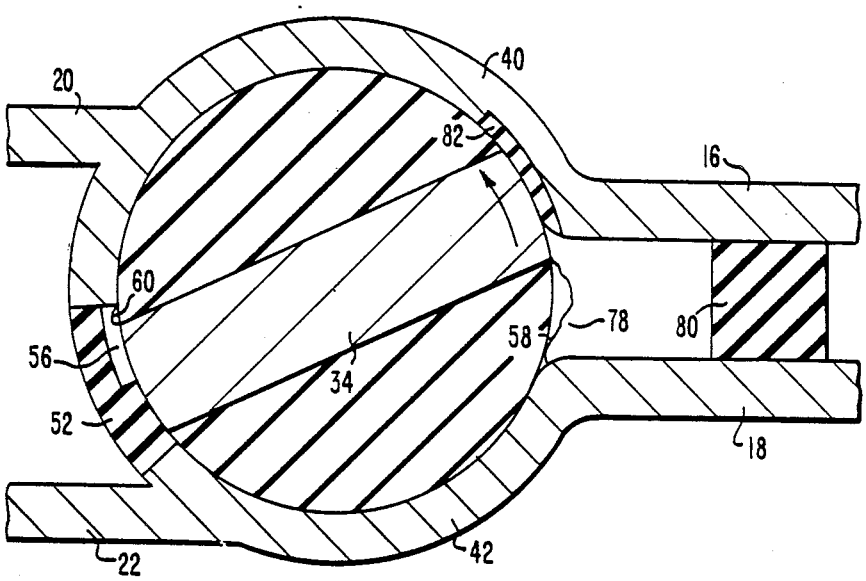
FIG. 7 is an alternative firing switch for use with the launcher of FIG. 1 in accordance with the present invention.

FIG. 7 is an alternative firing switch in accordance with the present invention for use in the launcher of FIG. 1. In this embodiment, an aperture 78 has been provided in the stator such that as conducting element 34 passes aperture 78, an arc 58 is drawn which is propelled into the breech of conductive rails 16 and 18, and serves as a means for conducting current between the rails and for propelling a projectile 80 along the rails. Insulation 82 is disposed along a portion of inner cylindrical surface 44 to ensure the commutation of current from conducting element 34 into rails 16 and 18. It should be understood that the projectile 80 must seal the bore between conductive rails 16 and 18 or must be equipped with sealing means such as an insulating sabot structure to prevent arc leakage in front of the projectile.

Although particular embodiments of the present invention have been described in great detail, it should be understood that various changes and modifications may be made without departing from the scope of this invention. It is therefore intended that the appended claims cover all such changes and modifications that fall within the scope of the invention.

What is claimed is:

1. A switch for switching very large DC current comprising:
- a rotor having an outer cylindrical surface;
- a conducting element extending transversely through said rotor, said element having radial ends terminating at angularly spaced locations on the cylindrical surface of said rotor;
- a stator having an inner cylindrical surface;
- two brush members defining angularly spaced portions of said stator cylindrical surface, each of said brush members terminating in arcuate surfaces complementary to and in sliding contact with the cylindrical surface of said rotor, with the width of said arcuate surfaces increasing in an axial direction along said stator cylindrical surface;
- means for rotating said rotor and for moving said rotor axially along said stator; and
- insulation members disposed between said brush members, along said inner cylindrical surface of said stator.

2. A switch as recited in claim 1, wherein said insulation members terminate in arcuate surfaces complementary to said cylindrical surface of said rotor with the width of said insulation arcuate surfaces decreasing in said axial direction along said stator cylindrical surface.

3. A switch as recited in claim 1, wherein the width of said insulation members at one end of said stator is less than the width of said conducting element.

4. A switch as recited in claim 1, wherein said means for rotating and for moving further serves as means for monotonically changing the speed of rotation of said rotor as said rotor moves axially along said stator.

5. A switch as recited in claim 1, wherein said stator defines an aperture disposed between said brush members.

6. A switch as recited in claim 1, wherein said stator defines an arc chamber extending axially along and arcuately around a portion of said inner cylindrical surface of said stator.

7. A switch as recited in claim 1, further comprising:
- a plurality of conductive leaves electrically connected to each of said radial ends of said conducting element.

8. A switch as recited in claim 1, further comprising:
- a conductive arc horn electrically connected to one of said radial ends of said conducting element.

9. A switch as recited in claim 1, wherein said conducting element extends diametrically through said rotor and said brush members are oriented diametrically opposite each other.

10. An electromagnetic projectile launcher comprising:
- a rotor having an outer cylindrical surface;
- a conducting element traversely through said rotor, said element having radial ends terminating at angularly spaced locations on the cylindrical surface of said rotor;
- a stator having an inner cylindrical surface;
- two brush members defining angularly spaced portions of said stator cylindrical surface, each of said brush members terminating in an arcuate surface complementary to and in sliding contact with the cylindrical surface of said rotor, with the width of said arcuate surfaces increasing in an axial direction along said stator cylindrical surface;
- means for rotating said rotor and for moving said rotor axially along said stator;
- a source of current connected between said brush members;
- a pair of conductive projectile launching rails, each of said rails connected to one of said brush members;
- means for conducting current between said rails and for propelling a projectile along said rails; and
- insulation members disposed between said brush members, along said inner cylindrical surface of said stator.

11. An electromagnetic projectile launcher as recited in claim 10, wherein said insulation members terminate in arcuate surfaces complementary to said cylindrical surface of said rotor with the width of said insulation arcuate surfaces decreasing in said axial direction along said stator cylindrical surface.

12. An electromagnetic projectile launcher as recited in claim 10, wherein the width of said insulation members at one end of said stator is less than the width of said conducting element.

13. An electromagnetic projectile launcher as recited in claim 10, wherein said means for rotating and for moving further serves as means for monotonically changing the speed of rotation of said rotor as said rotor moves axially along said stator.

14. An electromagnetic projectile launcher as recited in claim 10, wherein said brush members define an aperture disposed between said conductive projectile launching rails.

15. An electromagnetic projectile launcher as recited in claim 10, wherein said insulation members define an arc chamber extending axially along and arcuately around a portion of said inner cylindrical surface of said stator.

16. An electromagnetic projectile launcher as recited in claim 10, further comprising:

a plurality of conductive leaves electrically connected to each of said radial ends of said conducting element.

17. An electromagnetic projectile launcher as recited in claim 10, further comprising:

a conductive arc horn electrically connected to one of said radial ends of said conducting element.

18. An electromagnetic projectile launcher as recited in claim 10, wherein said conducting element extends diametrically through said rotor and said members are oriented diametrically opposite each other.

* * * * *